United States Patent [19]

Duncan

[11] Patent Number: 4,986,759

[45] Date of Patent: Jan. 22, 1991

[54] TOOTHBRUSH CABINET

[76] Inventor: Elizabeth S. Duncan, 14621 Gimbel Dr., Chester, Va. 23831

[21] Appl. No.: 435,618

[22] Filed: Nov. 13, 1989

[51] Int. Cl.[5] ..... A47G 29/08

[52] U.S. Cl. ..... 312/206; 211/DIG. 1; 211/66

[58] Field of Search ..... 211/87, 66, DIG. 1; 312/206, 207; 248/110

[56] References Cited

U.S. PATENT DOCUMENTS

D. 280,581 9/1985 Altadonna .
1,228,261 5/1917 Taylor .
2,414,653 1/1947 Cookholder ..... 211/DIG. 1
3,124,399 3/1964 Seta ..... 312/206

*Primary Examiner*—Kenneth J. Dorner
*Assistant Examiner*—Gerald A. Anderson

[57] ABSTRACT

A toothbrush storage mechanism that includes a number of rectangular boxes having permanent magnets thereon for attaching the individual boxes to a magnetically permeable mounting plate carried on a bathroom wall. The individual boxes can be selectively removed from the mounting plate and placed in a suitcase when it is desired to go on an overnight trip (when the contained toothbrush will be needed).

1 Claim, 1 Drawing Sheet

TOOTHBRUSH CABINET

BACKGROUND AND SUMMARY OF THE INVENTION

This invention relates to a toothbrush storage mechanism usable in a bathroom and also within a suitcase (while traveling). The storage mechanism includes a number of small rectangular box structures, each large enough to contain one toothbrush. Each box structure has a permanent magnet incorporated into its rear wall; a cooperating mounting plate of magnetically permeable material is affixed to the bathroom wall, such that the individual storage boxes can be magnetically attached to the plate or removed from the plate (for disposition in a suitcase).

The rectangular boxes have flat side faces so that a number of the boxes can be positioned alongside one another on the mounting plate. The individual boxes take up a relatively small space on the bathroom wall, while isolating the individual toothbrushes from one another to minimize migration of germs from brush to brush.

Box construction is modular in nature, such that the array of boxes on the bathroom wall presents an attractive unitary appearance. The toothbrushes are completely concealed from view, thereby enhancing the overall attractiveness of the bathroom decor. As noted above, each box can be individually removed from the bathroom wall for disposition in a suitcase for travel purposes. When the person returns from the trip the individual boxes (with the contained toothbrushes) are returned to their installed positions in the bathroom. No tools are needed to remove or reinstall the toothbrush containment boxes.

THE DRAWINGS

DESCRIPTION OF A PREFERRED EMBODIMENT OF THE INVENTION

Figure 1:
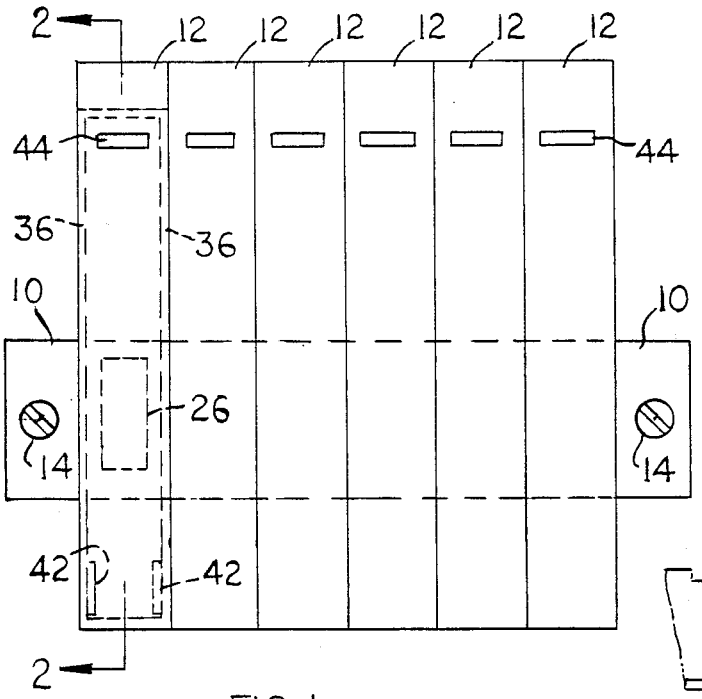
FIG. 1 is a front elevational of a toothbrush storage mechanism embodying the invention.

The drawings show a toothbrush storage mechanism that includes a rectangular plate 10 and six rectangular box structures 12 magnetically attached to the front (exposed) face of plate 10. Each box structure 12 is large enough to contain one toothbrush. Any one (or all) of the box structures can be manually removed (pulled) from plate 10 should it be desired to place the box structure (and contained toothbrush) in a suitcase, e.g. when taking an overnight trip.

The drawings show six box structures 12, but it should be understood that the number of boxes is determined by the number of persons in the family and the horizontal length of mounting plate 10. Plate 10 can have a horizontal length equivalent to the combined width of the boxes making up the storage system, in which case plate 10 will be complete concealed from view (by the boxes).

Plate 10 is formed of a magnetically permeable material. Flat head screws 14 extend through the plate into the bathroom wall 16 to immovably attach the plate to the wall surface. The plate will extend out from the wall surface by the amount of the plate thickness. The upper edge 20 of plate 10 may be angled (beveled) outwardly and upwardly.

Each box structure 12 comprises a rear wall 24 having a permanent magnet 26 extending therealong at a point about midway between the upper and lower edges of the wall. Magnet 26 is disposed a slight distance forwardly from the general plane of wall 24 such that when the magnet is flush against the exposed face of mounting plate 10 a shoulder 28 on the box rear wall will snap over the upper edge 20 of plate 10. Shoulder 28 carries any vertical loads, whereas magnet 26 handles horizontal loads, i.e. forces tending to pull the box away from plate 10. The box can be manually pulled away from plate 10 whenever necessary.

Figure 2:
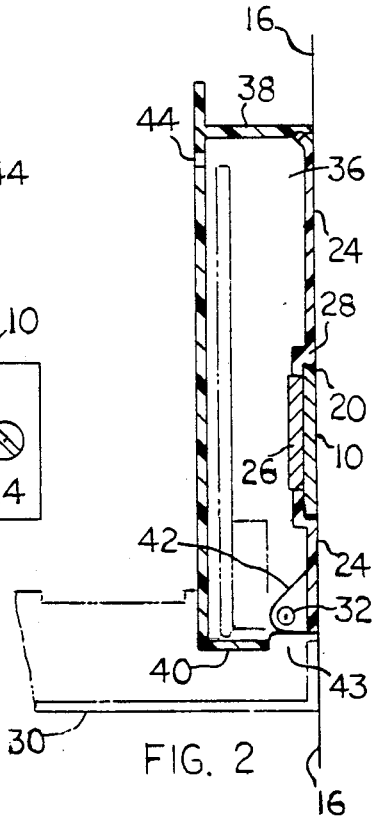
FIG. 2 is a sectional view on line 2—2 in FIG. 1.

Box structure 12 can be formed in various ways, while still achieving its toothbrush containment function. As shown in the drawing, the box comprises an upright rectangular tray 30 having a pivotal connection 32 with rear wall 24. Tray 30 comprises an elongated rectangular front wall 34, two elongated side walls 36 extending normal to wall 34, a short transverse top wall 38 extending normal to wall 34, and a short transverse bottom wall 40 extending normal to wall 34. FIG. 2 shows tray 30 in its normal toothbrush-storage position extending upright in front of box rear wall 24. The rear edges of tray side walls 36 will be in near adjacency to bathroom wall 16, such the defined box structure (tray 30 and rear wall 24) will completely enclose a single toothbrush.

Rear wall 24 has two forwardly extending ears 42 near its lower edge. These ears 42 extend alongside the inner side faces of tray walls 36; pivot pins extend between the ear and walls 36, such that tray 30 can be swung down from its upright storage position (full lines in FIG. 2) to a prone position (dashed lines in FIG. 2). Wall 40 abuts the bathroom wall 16 to limit the downward swinging motion. When tray 30 is in its prone position a toothbrush can be deposited into the tray, or removed from the tray. The tray can thereafter be swung back up to its normal full line position.

Any suitable latch mechanism can be used to hold tray 30 in its upright position. As shown in FIG. 2, the latch can be a notch in the edge of wall 38 configured to snap over the upper end edge of rear wall 24.

Each box structure preferably has air holes therein for circulation of air through the box. The illustrated box has an upper air hole 44 and a lower air vent 43 (formed by the clearance space required to permit pivotable motion of tray 30). The extreme upper end of tray wall 34 extends upwardly beyond tray wall 38 to form a finger-engagable handle that is useful for swinging tray 30 between its two positions.

The six box structures 12 are similarly constructed. If any one of the boxes is removed from plate 10 the remaining boxes can be slid horizontally along plate 10 so as to be close together, as shown in FIG. 1. The array of boxes presents an attractive unitary appearance on the bathroom wall, while completely concealing the toothbrushes from view. One or all of the boxes can be removed from plate 10 should it be desired to carry the toothbrushes in a suitcase for an overnight trip.

What is claimed is:

1. A toothbrush storage mechanism comprising a flat magnetically permeable mounting plate adapted for facial placement against a bathroom wall; a series of rectangular toothbrush containment boxes affixable to the exposed face of said mounting plate; each box being large enough to contain only one toothbrush; each box comprising a rear wall (24) having a flat permanent magnet carried thereon for placement against the magnetically permeable mounting plate, whereby each said box is magnetically attached to the mounting plate; each permanent magnet having sufficient magnetic force to retain the associated box on the mounting plate, while permitting the box to be manually removed from the plate for disposition in a suitcase; the individual boxes being oriented vertically alongside one another on the mounting plate so that the individual toothbrushes extend vertically in parallelism with one another;

each box comprising the aforementioned rear wall and a vertically elongated tray having a pivotable connection with the box rear wall at its lower edge, whereby the tray can be manually moved between an upright storage position and a prone toothbrush loading position extending horizontally away from said rear wall;

each box rear wall having two laterally spaced ears extending therefrom at its lower edge; each tray comprising a vertically elongated front wall, two vertically elongated side walls extending normal to the front wall, a top wall extending normal to the front wall, and a bottom wall extending normal to the front wall, and pivot pins extending from the tray side walls through said laterally spaced ears to form pivotal connections between the tray and the rear wall;

the tray side walls extending from the tray front wall into abutment with the box rear wall when the tray is in its upright storage position, the space between the tray side walls being open and completely unobstructed so that when the tray is in its prone position a toothbrush can be deposited into the tray by laying it directly against the upwardly facing surface of the tray front wall;

each said tray bottom wall extending from the associated front wall a lesser distance than the spacing between the tray front wall and box rear wall, so that when the tray is swung down to its prone position the tray bottom wall will be vertically oriented in the space directly below the box rear wall;

the individual boxes being oriented on the mounting plate so that the side walls on adjacent trays are in near adjacency to each other, with minimal clearance between the trays whereby the boxes present a unitary modular appearance.

* * * * *